US007600271B2

(12) United States Patent
Piche et al.

(10) Patent No.: US 7,600,271 B2
(45) Date of Patent: Oct. 13, 2009

(54) VERTICALLY ACTUABLE ROOF COVER FOR A SPA

(75) Inventors: Mario Piche, Calgary (CA); Raymond Bussiere, Calgary (CA)

(73) Assignee: Sterling Holdings Corporation, Calgary (CA)

( * ) Notice: Subject to any disclaimer, the term of this patent is extended or adjusted under 35 U.S.C. 154(b) by 552 days.

(21) Appl. No.: 11/162,557

(22) Filed: Sep. 14, 2005

(65) Prior Publication Data

US 2007/0017016 A1 Jan. 25, 2007

(30) Foreign Application Priority Data

Jul. 23, 2005 (GB) ..... 0515168

(51) Int. Cl.
*E04H 4/00* (2006.01)

(52) U.S. Cl. ..... 4/498

(58) Field of Classification Search ..... 4/495, 4/488, 498, 501, 504, 667, 499, 503; 49/255, 49/280, 332, 336, 337, 348, 349
See application file for complete search history.

(56) References Cited

U.S. PATENT DOCUMENTS 2,536,511 A * 1/1951 Megies ..... 108/67
3,566,420 A 3/1971 Peterson et al.
3,679,174 A 7/1972 Boettcher
4,078,293 A 3/1978 Aine
4,426,744 A 1/1984 Love
4,598,506 A 7/1986 Nohl et al.
5,035,094 A 7/1991 Legare
5,737,780 A * 4/1998 Okita et al. ..... 4/667
5,745,932 A 5/1998 Barovetto
6,253,390 B1 * 7/2001 Laks ..... 4/495
6,718,566 B1 4/2004 Wilson

FOREIGN PATENT DOCUMENTS

DE 2521829 5/1975
FR 2555219 5/1985

* cited by examiner

*Primary Examiner*—Huyen Le
(74) *Attorney, Agent, or Firm*—Sean W Goodwin; Linda M. Thompson

(57) ABSTRACT

A vertically actuable cover for a spa comprises telescoping members which utilize a rack and pinion system to raise and lower the cover from the spa. In the lowered position the cover protects the spa and in the elevated position the cover acts as a roof over the spa.

13 Claims, 8 Drawing Sheets

VERTICALLY ACTUABLE ROOF COVER FOR A SPA

FIELD OF THE INVENTION

Embodiments of the invention relate to spa covers and more particularly to spa covers which are moveable vertically between a position directly atop the spa and a position elevated above the spa to act as a roof structure during spa use.

BACKGROUND OF THE INVENTION

It is known to cover hot tubs or spas to prevent contamination due to environmental debris, such as leaves, pollens and the like, to prevent excessive evaporation when the spa is not in use and to act as a safety measure to prevent animals, small children and the like from falling into the water when unsupervised.

Most conventional spa covers are fabric covered foam structures which rest atop the spa when the spa is not in use and which are removed, either by sliding off the tub or by folding at a middle and lifting to a position away from the top of the tub, such by a support frame wherein the cover is suspended vertically in the folded position adjacent a side of the tub. The fabric covers may be susceptible to chemical vapors, such as chlorine, are prone to tearing at seams exposing the foam layers to the elements and to the steam and vapors from the tub and are generally susceptible to normal wear and tear necessitating multiple replacements during the life of the average spa.

It is known to provide fixed structures built around the hot tub to provide an element of protection for use during inclement weather or to prevent excessive exposure to the sun. Most often the structure is independent of the cover and remains in a fixed position around the tub, the roof portion being fixed above the spa to permit use of the spa. While these structures may meet the needs of the user by providing a rigid or semi rigid roof structure, they add additional expense by requiring a spa cover to be used as well.

Conventional spa covers are not designed to handle the weight of a person or persons resting on the cover. As the spa covers are typically flat however, individuals may be encourage to walk or otherwise provide undue weight on the cover, such as when shoveling snow from a deck in which the spa is recessed, which results in damage not only to the cover but to the spa itself.

Others have attempted to provide domed rigid or semi-rigid cover structures which, like the conventional cover, reside atop the spa when in use and which are pivoted or slid laterally away from the spa when the spa is to be used.

It is known to provide a vertically actuable cover to a swimming pool or a spa. U.S. Pat. No. 3,566,420 to Peterson et al teaches hydraulic actuators used to raise and lower a cover from a swimming pool and U.S. Pat. No. 6,718,566 to Wilson teaches a plurality of telescoping and threaded sections which are used to raise and lower a cover over a spa.

There remains interest in the industry to find reliable, relatively simple and inexpensive lift systems for raising and lowering roof structures over spas, which can act to replace a conventional spa cover when in a lowered, spa engaging position and which act as a roof when in the raised position.

SUMMARY OF THE INVENTION

A cover assembly for a structure, such as a spa, is vertically actuated between a lowered position atop the spa to an elevated position above the spa where the cover acts as a roof over the spa. The actuation of the cover is accomplished using a unique rack and pinion system within telescoping tubular members which form actuation members upon which the cover is supported.

In a preferred embodiment, the rack and pinion system comprises a rack and a worm gear which is rotatably driven by an electric motor. Limit switches act to stop the motor when the cover has reached the elevated or lowered position. The cover is supported on a plurality of actuation members, typically one at each corner of the cover, and each of the electric motors is connected through a single circuit so as to coordinate the actuation members to support and vertically actuate the cover. A cable is connected between the rack and a third and upper telescoping member of each actuation member for assisting in raising and lowering cover. The cable is guided by a pulley which is connected at a top end of the rack.

Preferably, stops are formed at top and bottom ends of the telescoping tubular members to limit the upward travel of the telescoping members within each other to prevent the telescoping members from becoming disconnected during elevation of the cover and, in the case of the cable-assisted embodiment, to lift the intermediate member with the upper tubular member.

In a broad aspect therefore, a cover assembly comprises a cover supported on at least one actuation member, the cover being actuable between a lowered position atop the structure to an elevated position above the structure so as to act as a roof thereover, wherein the at least one actuation member further comprises:

a plurality of telescoping tubular members;

a rack and pinion assembly positioned within the telescoping tubular members and connected thereto; and means for rotating the pinion in engagement with the rack for raising and lowering the plurality of telescoping tubular members connected thereto for actuating the cover between the lowered and the elevated positions.

DETAILED DESCRIPTION OF THE PREFERRED EMBODIMENT

Figure 1:
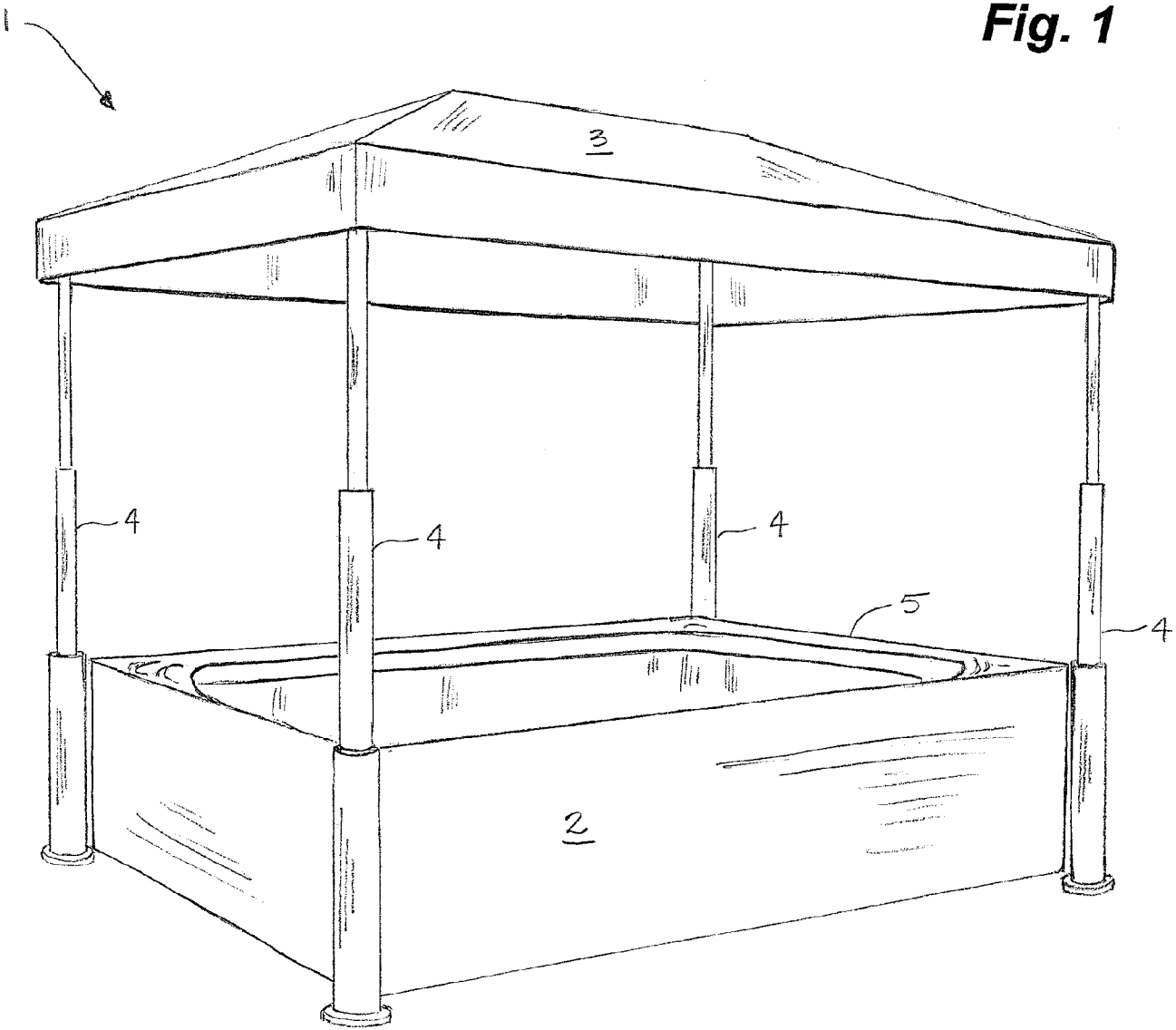
FIG. 1 is a perspective view of a spa cover according to one embodiment, shown in a raised position.
Figure 2:
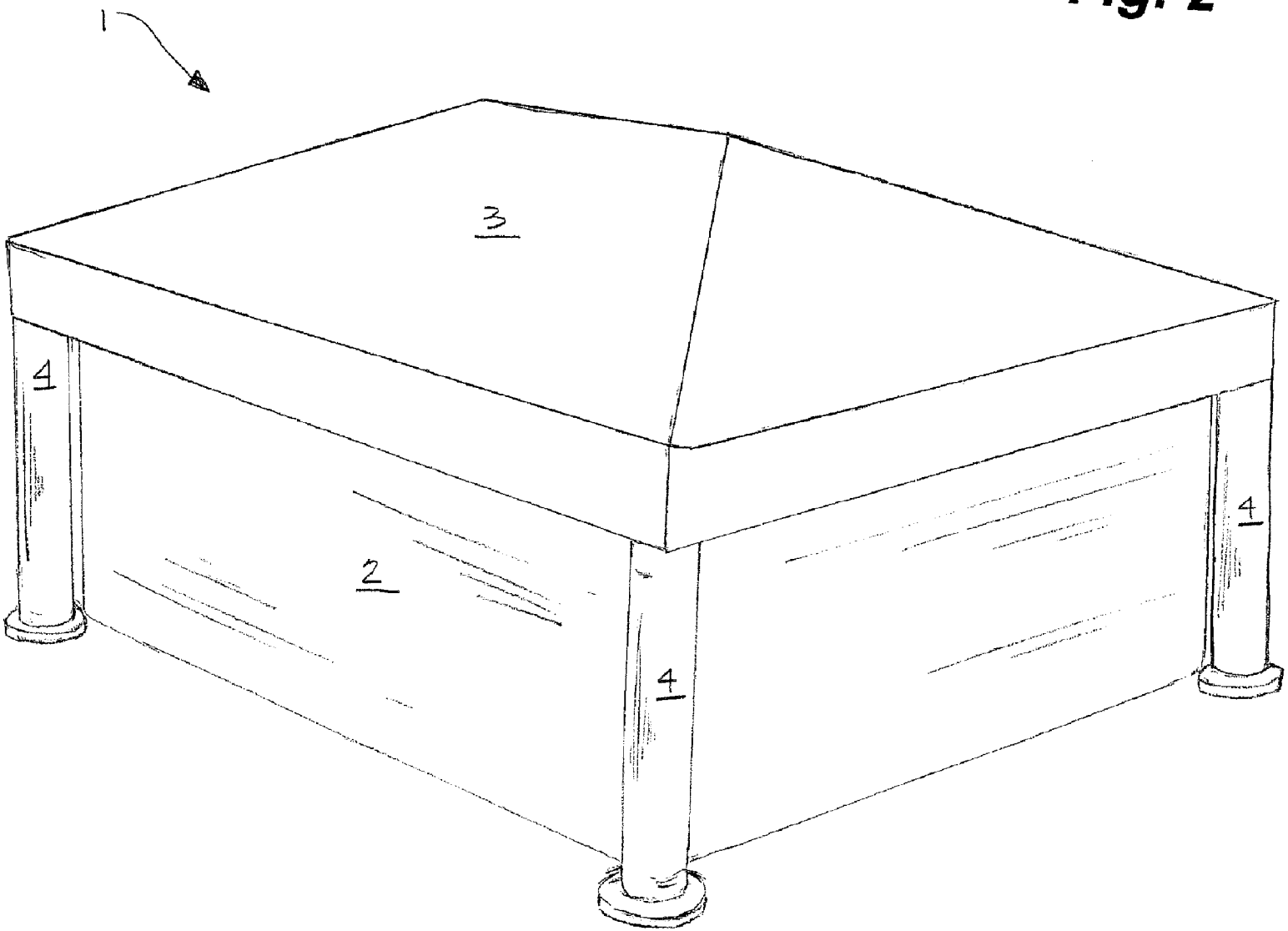
FIG. 2 is a perspective view according to FIG. 1 shown in a lowered position.
Figure 3A:
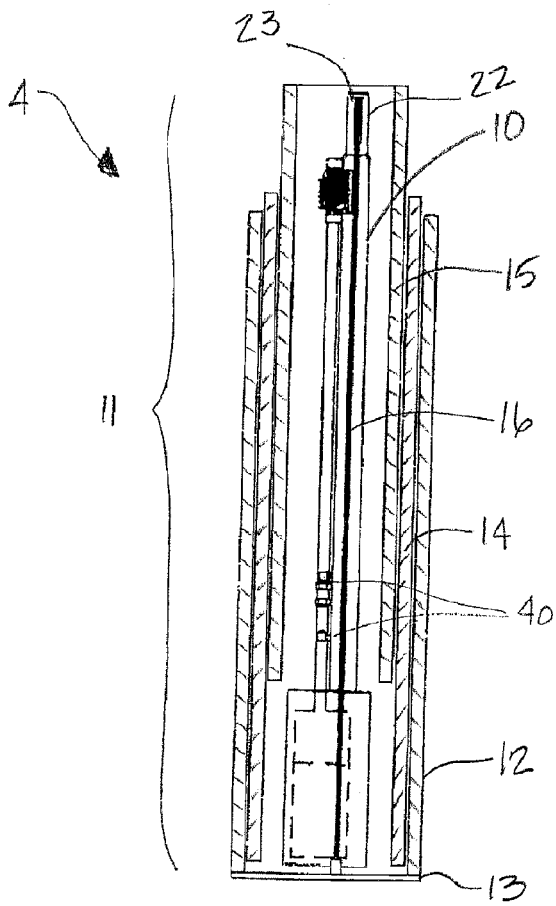
FIG. 3*a* is a longitudinal sectional side view of an actuation mechanism for raising and lowering the spa cover, shown in the lowered position.
Figure 3B:
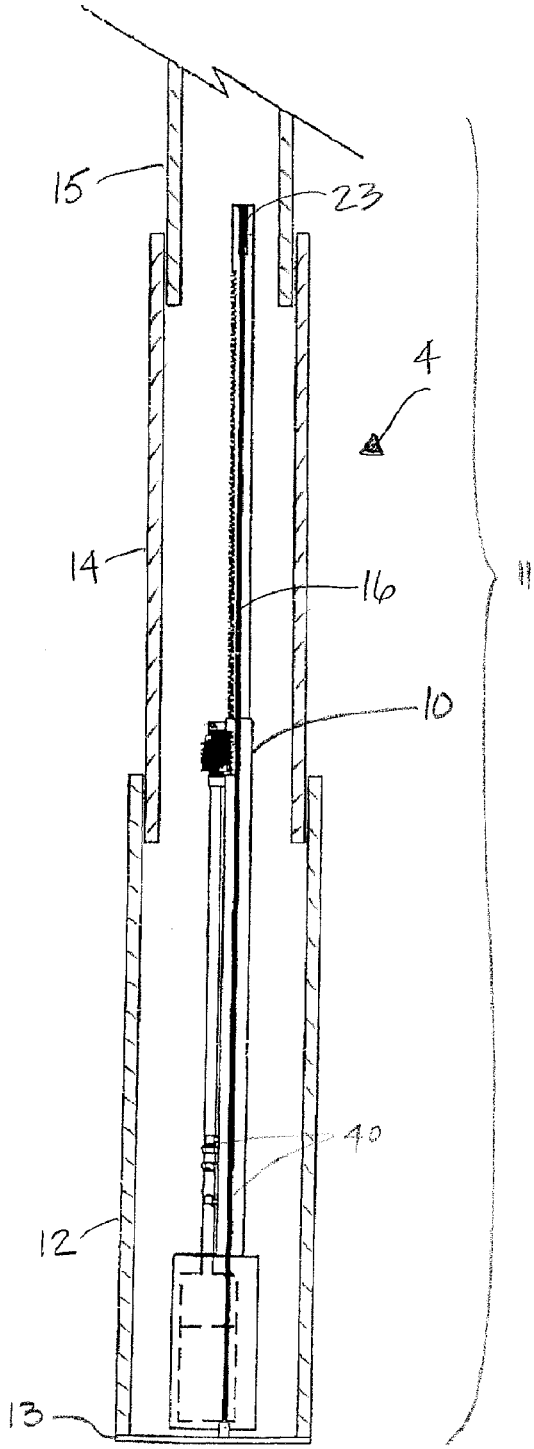
FIG. 3*b* is a longitudinal sectional side view according to FIG. 3*a*, shown in the raised position.
Figure 4A:
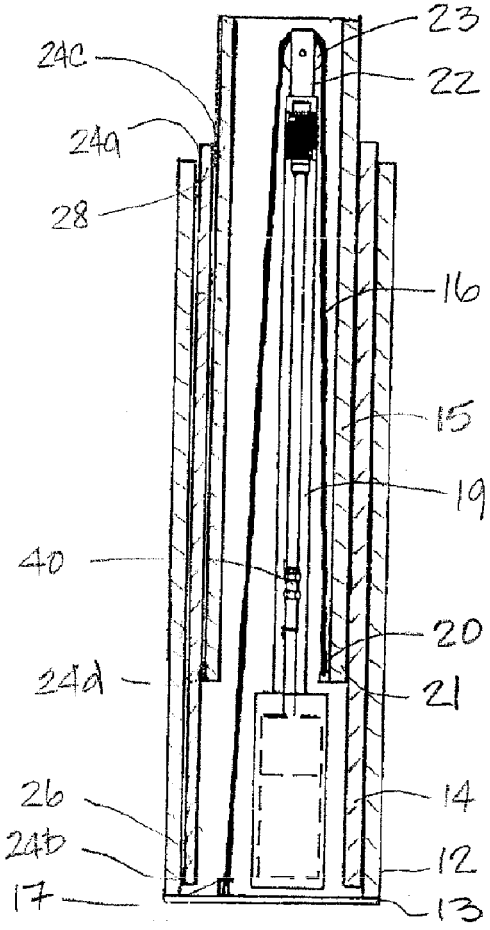
FIG. 4*a* is a longitudinal sectional front view according to FIG. 3*a*, in the lowered position.
Figure 4B:
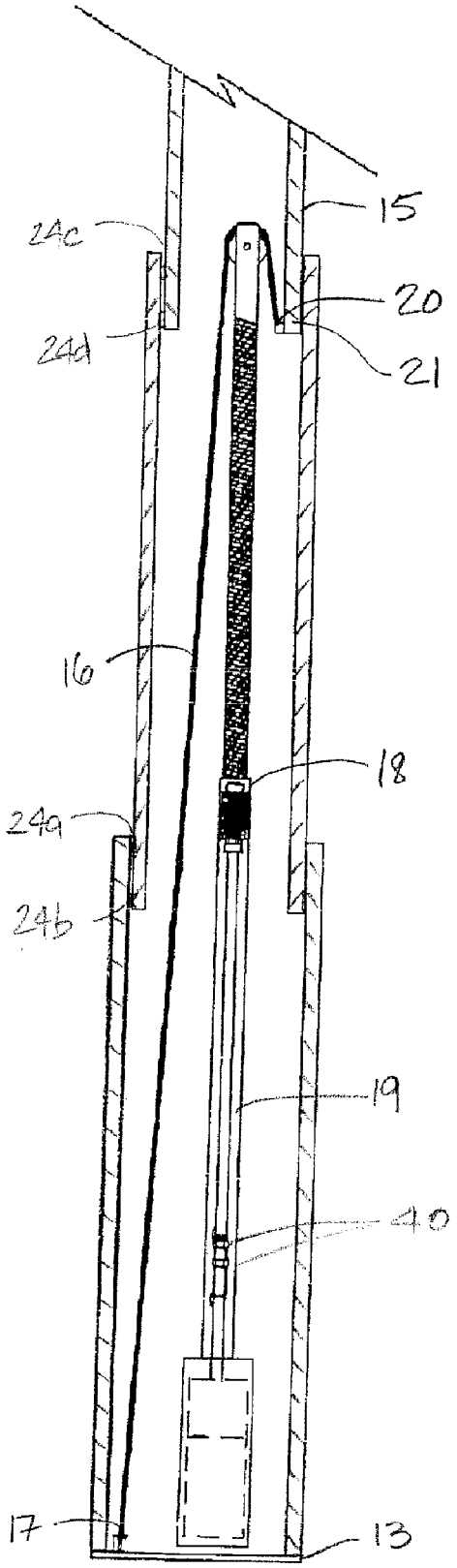
FIG. 4*b* is a longitudinal sectional front view according to FIG. 3*a*, in the raised position.
Figure 5:
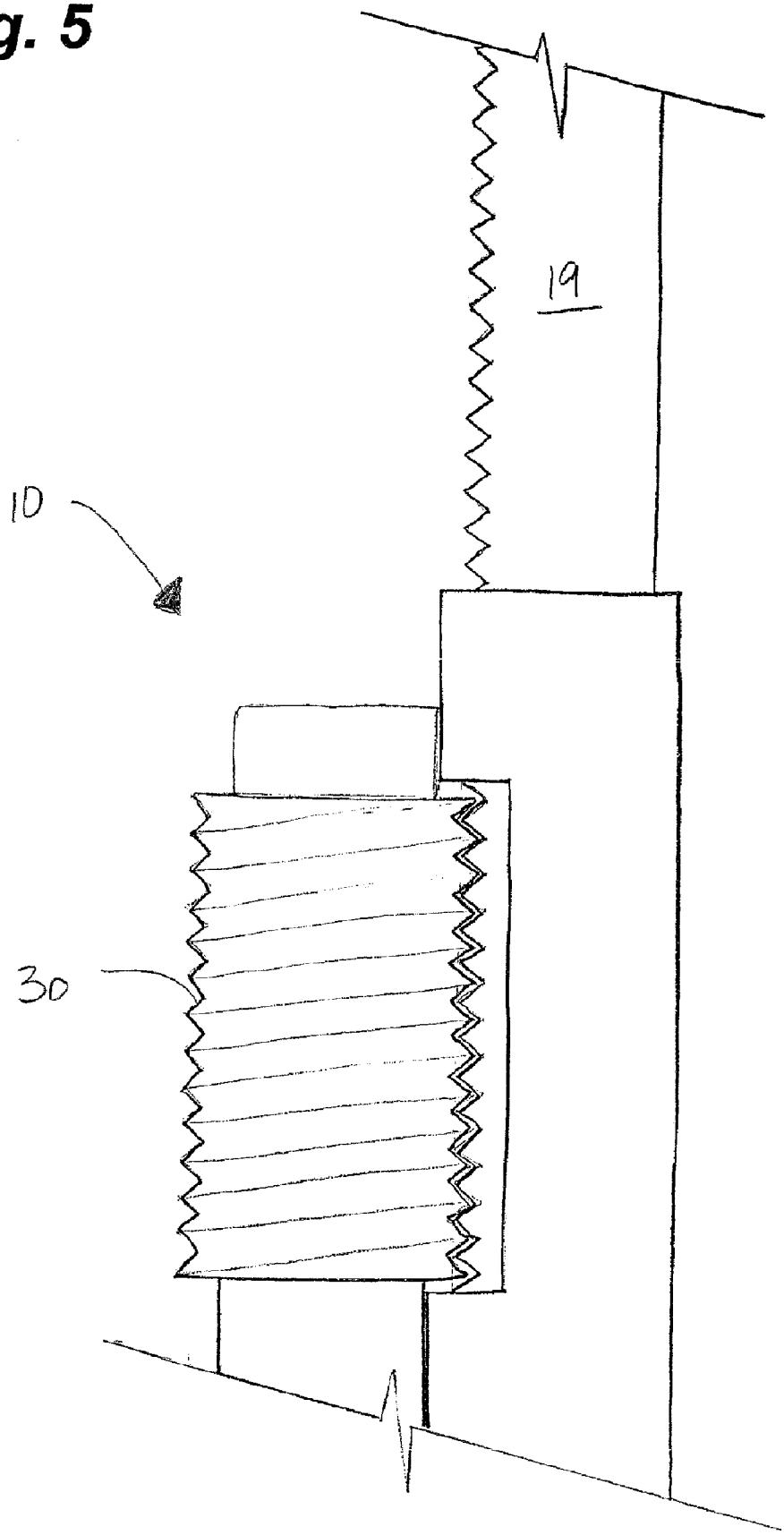
FIG. 5 is a detailed view of the actuation mechanism, more particularly a worm gear and rack.

Having reference to FIGS. 1 and 2, a cover apparatus 1 for a structure 2, such hot tub or spa, comprises a cover 3 supported on actuation members 4, typically positioned at each corner of the spa 2. The actuation members 4 elevate the cover 3 from a lowered position, wherein the cover 3 rests atop or adjacent a top edge 5 of the spa 2, to a raised position, wherein the cover 3 is supported over the spa 2 to act as a roof.

As shown in FIG. 3*a*-6 and in a preferred embodiment, the actuation members 4 comprise a rack and pinion system 10 for raising and lowering the cover 3. Each actuation member 4 further comprises two or more telescoping tubular members 11. The tubular members 11 may be, but are not limited to being circular, rectangular or square in cross-section. Preferably, each actuation member 4 comprises three telescoping tubular members 11, a lower tubular member 12 secured to a base 13, an intermediate tubular member 14 and an upper tubular member 15 upon which the cover 3 is supported. The rack and pinion system 10 is housed within the telescoping tubular members 11 and connected thereto for actuation of at least the intermediate tubular member 14. The upper tubular member 15 is connected thereto through a cable 16 which is anchored, at a first end 17, to the base 13 or to an upper end 18 (FIG. 6) of a rack 19 of the rack and pinion system 10 for movement therewith and, at a second end 20, to a lower end 21 of the upper tubular member 15. The cable 16 is guided at an upper end 22 of the rack 19 by a pulley 23.

Preferably, a stop 24*a* is formed at an upper end 25 of the lower tubular member 12 for engaging a stop 24*b* at a lower end 26 of the intermediate tubular member 14 for retaining the intermediate telescoping tubular member 14 in the lower telescoping tubular member 12 and to prevent the intermediate tubular member 14 from being pulled out of the lower tubular member 12, when the cover apparatus 1 is actuated to the raised position. Similarly, a stop 24*c* is formed at an upper end 28 of the intermediate member 14 for engaging a stop 24*d* at the lower end 21 of the upper tubular member 15 for retaining the upper tubular member 15 within the intermediate tubular member 14 during actuation to the elevated position.

Figure 6:
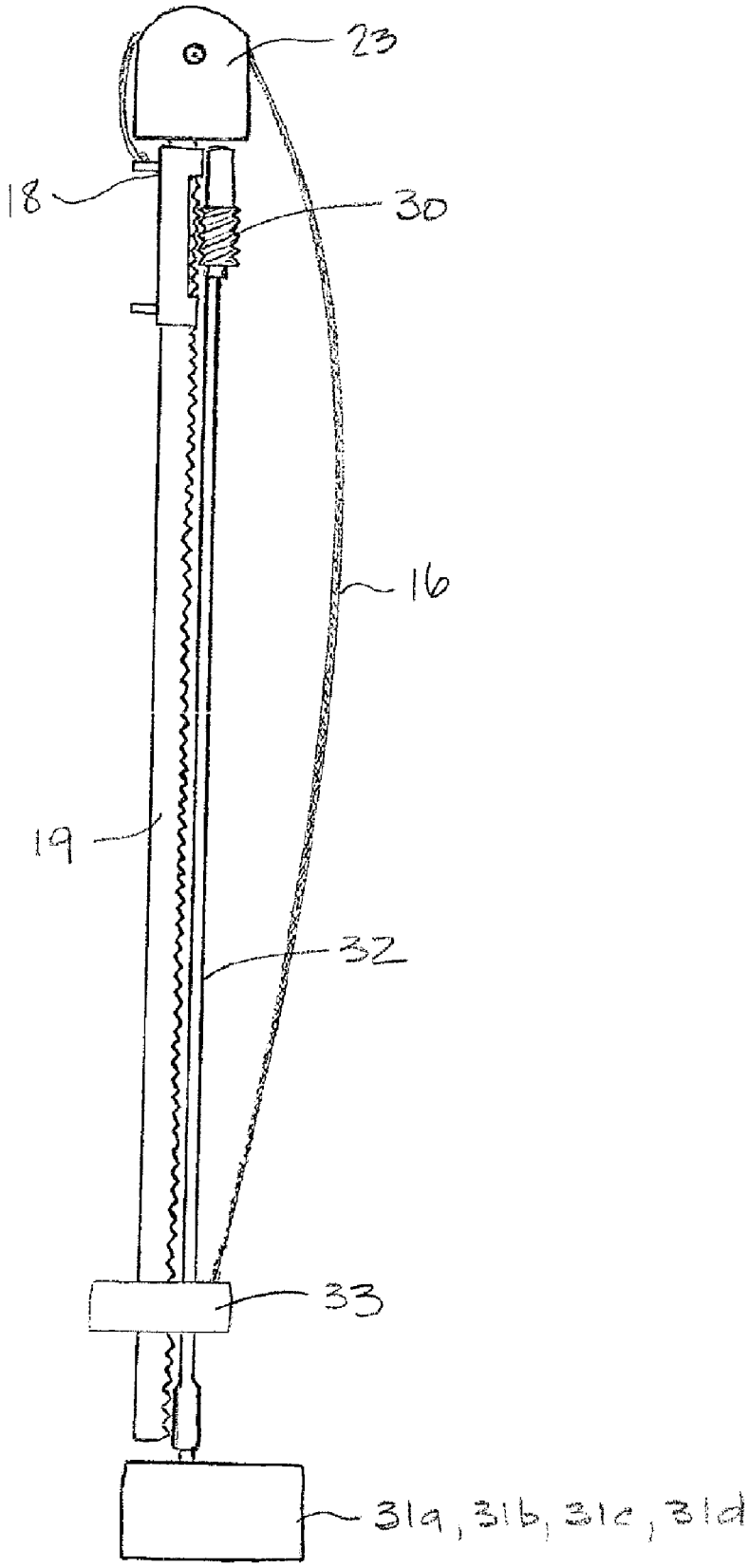
FIG. 6 is a perspective view of the worm gear and rack of FIG. 5 shown in the lowered position and illustrating an alternate embodiment for connection of the upper tubular member
Figure 7:
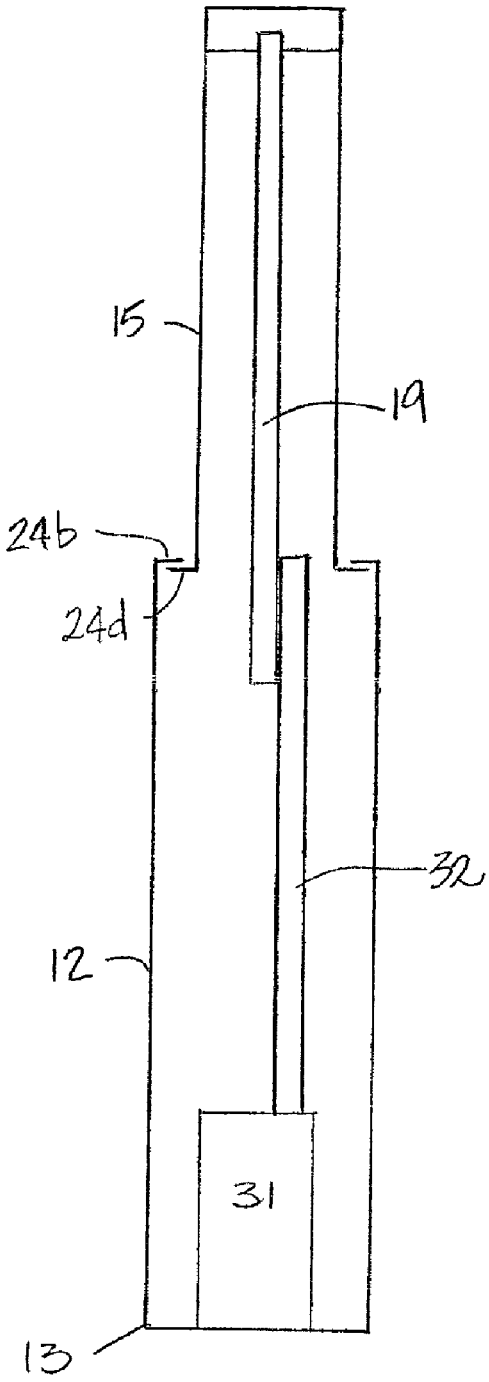
FIG. 7 is a schematic sectional view of an embodiment of an actuation mechanism having two telescoping tubular members, the upper tubular member being connected to the rack.
Figure 8:
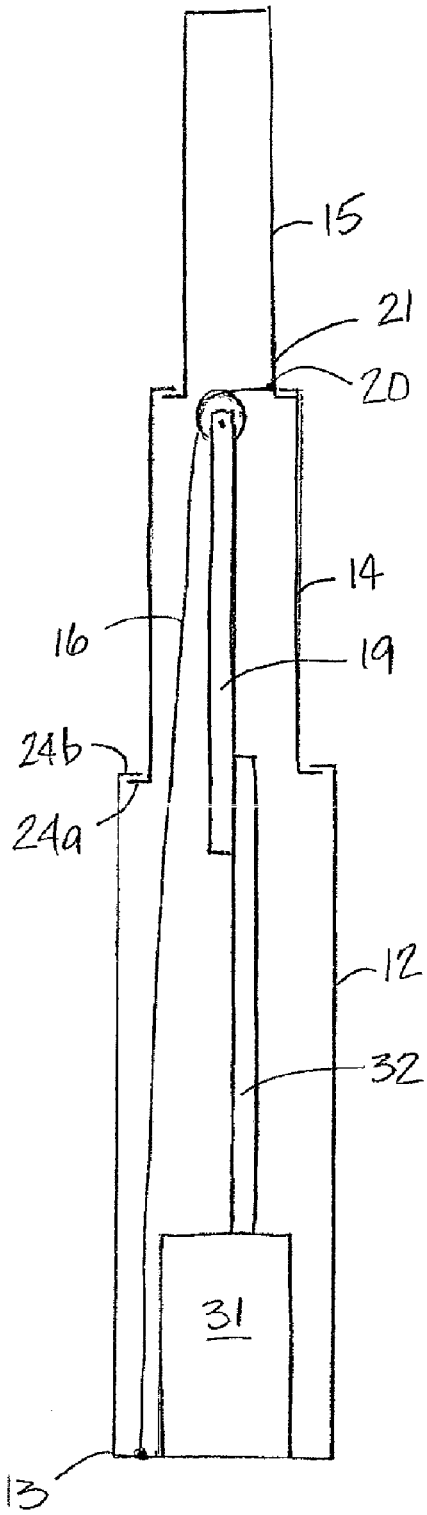
FIG. 8 is a schematic section view of an embodiment of the invention according to FIGS. 3*a*-4*b* having three telescoping tubular members, the upper tubular member being connected to the rack through a cable and pulley.

Best seen in FIGS. 6-8 and most preferably, the rack and pinion system 10 comprises a worm gear 30 which is rotatably connected to a motor 31, such as an electric gear motor, by a rod 32. The worm gear 30 is rotated to raise and lower the rack 19. For an actuation member 4 having two telescoping tubular members 11 (FIG. 7), rack 19 directly raises upper telescoping member 15. In the case of an actuation member 4 having three telescoping tubular members 11 (FIG. 8), the rack 19 raises and lowers the upper telescoping member 15 via the cable 16, the upper tubular member 15 raising and lowering the intermediate tubular member 14 through engagement of the stops 24*c*,24*d*. In the preferred embodiment (FIG. 6) the cable 16 is connected at the second end 20 to a ring 33 which is used for mounting the cable 16 inside the lower end 21 of the upper tubular member 15.

Figure 10:
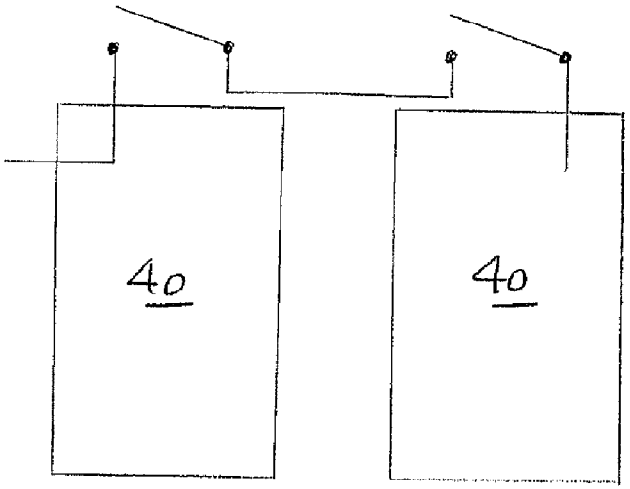
FIG. 10 is a schematic of a circuit for operating the plurality of gear motors according to FIG. 9, in series.
Figure 9:
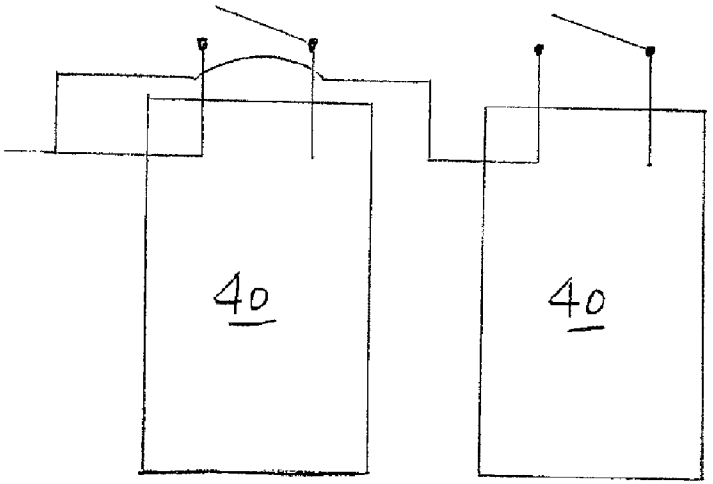
FIG. 9 is a schematic of a circuit for independently operating of a plurality of gear motors for rotationally powering worm gears.

Preferably, each actuation member 4 is powered by an electric gear motor 31. Most preferably, all of the gear motors 31*a*, 31*b*, 31*c*, 31*d* are connected through a single circuit so that when the circuit is activated, all of the actuation members 4 are caused to move at the same time. Limit switches 40 are positioned on the rack and pinion system 10 to stop the gear motor 31 when the cover 3 has reached the lowered or the raised position. As shown in FIGS. 9 and 10, the gear motor limit switches 40 may be independent (FIG. 9) or in series (FIG. 10).

In a preferred embodiment, the cover 3 is a substantially rigid, domed pyramidal-shaped cover manufactured of a foam core and having a fabric covering such as is known in the industry to provide protection and insulation as is also known with conventional spa covers. Further, the domed shape is particularly advantageous for spas which are enclosed in a deck structure to prevent persons or animals from walking or lying on the cover 3 and to minimize the amount of snow buildup on the cover 3 in snow-prone climates.

What is claimed is:

1. A vertically-actuable cover assembly for a structure comprising:

a cover supported on two or more actuation members, the cover being actuable between a lowered position atop the structure to an elevated position above the structure so as to act as a roof thereover, wherein the two or more actuation members further comprises:

at least two telescoping tubular members;

a rack and pinion assembly positioned within the at least two telescoping tubular members and connected thereto;

means for rotating the pinion in engagement with the rack for raising and lowering at least one of the at least two telescoping tubular members connected thereto for actuating the cover between the lowered and the elevated positions a pulley connected at a top end of the rack; and a cable anchored at a first end and connected at a second end to at least one of the at least two telescoping tubular members and guided by the pulley so as to aid in raising and lowering the at least one of the plurality of telescoping tubular members.

2. The cover assembly as described in claim 1 wherein the means for rotating the pinion in engagement with the rack is a motor.

3. The cover assembly as described in claim 2 further comprising:

limit switches in the rack and pinion system for stopping the motor when the actuation members reach the elevated position.

4. The cover assembly as described in claim 2 further comprising:

limit switches in the rack and pinion system for stopping the motor when the actuation members reach the lowered position.

5. The cover assembly as described in claim 1 wherein the pinion is a worm gear.

6. The cover assembly as described in claim 1 further comprising four actuation members.

7. The cover assembly as described in claim 1 wherein the at least two telescoping tubular members comprise an upper telescoping tubular member and a lower tubular telescoping member and wherein the rack and pinion system is connected to the upper telescoping tubular member for raising and lowering the cover.

8. The cover assembly as described in claim 7 further comprising:

a cable connected at a first end to the rack and at a second end to the upper telescoping tubular member and guided by the pulley so as to aid in raising and lowering the upper telescoping tubular member.

9. The cover assembly as described in claim 1 wherein the at least two telescoping tubular members comprise an upper telescoping tubular member, an intermediate telescoping tubular member and a lower tubular telescoping member, the intermediate tubular member being engageable with the upper tubular member and wherein the rack and pinion system is connected to the upper telescoping tubular member for raising and lowering the cover.

10. The cover assembly as described in claim 9 further comprising:

a cable connected at a first end to the rack and at a second end to the upper telescoping tubular member and guided by the pulley so as to aid in raising and lowering the upper and intermediate telescoping tubular members.

11. The cover assembly as described in claim 9 further comprising stops formed at upper and lower ends of the at least two telescoping tubular members for retaining the upper telescoping tubular member in the intermediate telescoping tubular member and the intermediate telescoping tubular member within the lower telescoping tubular member when the actuation member is actuated to the elevated position.

12. The cover assembly as described in claim 1 wherein the at least two telescoping tubular members are circular in cross-section.

13. The cover assembly as described in claim 1 wherein the structure is a spa.

* * * * *